US009948067B2

(12) United States Patent
Shibata et al.

(10) Patent No.: US 9,948,067 B2
(45) Date of Patent: Apr. 17, 2018

(54) SPARK PLUG

(71) Applicant: DENSO CORPORATION, Kariya, Aichi-pref. (JP)

(72) Inventors: Masamichi Shibata, Kariya (JP); Ryuichi Ohno, Kariya (JP); Kenji Hattori, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/695,232

(22) Filed: Sep. 5, 2017

(65) Prior Publication Data

US 2018/0069378 A1 Mar. 8, 2018

(30) Foreign Application Priority Data

Sep. 6, 2016 (JP) ..... 2016-173408

(51) Int. Cl.
*H01T 13/32* (2006.01)
*H01T 13/34* (2006.01)
*H01T 13/08* (2006.01)

(52) U.S. Cl.
CPC ..... *H01T 13/32* (2013.01); *H01T 13/08* (2013.01); *H01T 13/34* (2013.01)

(58) Field of Classification Search
CPC ..... H01T 13/32; H01T 13/20; H01T 13/34; H01T 13/39
See application file for complete search history.

(56) References Cited

U.S. PATENT DOCUMENTS

2002/0067111 A1 6/2002 Shibata et al.
2010/0275869 A1* 11/2010 Musasa ..... C22C 1/0466 123/169 EL

FOREIGN PATENT DOCUMENTS

| | | |
|---|---|---|
| JP | 9-148045 | 6/1997 |
| JP | 2007-234435 | 9/2007 |
| JP | 2015-032573 | 2/2015 |

* cited by examiner

*Primary Examiner* — Mariceli Santiago
(74) *Attorney, Agent, or Firm* — Nixon & Vanderhye P.C.

(57) ABSTRACT

A spark plug for an internal combustion engine includes a cylindrical metal shell, a center electrode, and a ground electrode. The center electrode has an end portion which protrudes outside an end of the metal shell. The ground electrode is joined at an end thereof to the metal shell and has an inner surface facing the end portion of the center electrode. The ground electrode has a maximum width W meeting a relation of $1.3 \leq W \leq 2.0$. A distance d between the center of an end surface of the center electrode and the inner surface of the ground electrode on a plane extending through the center of the center electrode perpendicular to an axis of the spark plug is selected to meet a relation of $W+0.525 \leq d \leq 1.07W+0.66$. This ensures the stability of ignitability of the spark plug.

8 Claims, 14 Drawing Sheets

FIG.5

ABSOLUTE VALUE OF LEAN LIMIT A/F

| w \ d | 1.7 | 1.8 | 1.9 | 2.0 | 2.1 | 2.2 | 2.3 | 2.4 | 2.5 | 2.6 | 2.7 | 2.8 | 2.9 |
|---|---|---|---|---|---|---|---|---|---|---|---|---|---|
| 2.2 | 15.9 ~16.0 | 15.9 ~16.0 | 15.9 ~16.0 | 15.9 ~16.0 | 15.9 ~16.0 | 15.9 ~16.0 | 15.9 ~16.0 | 15.9 ~16.0 | 15.9 ~16.0 | 15.9 ~16.0 | 15.9 ~16.0 | 15.9 ~16.0 | 15.9 ~16.0 |
| 2.1 | 16.0 ~16.1 | 16.0 ~16.1 | 16.0 ~16.1 | 16.0 ~16.1 | 16.0 ~16.1 | 16.0 ~16.1 | 16.0 ~16.1 | 16.0 ~16.1 | 16.0 ~16.1 | 16.0 ~16.1 | 16.0 ~16.1 | 16.0 ~16.1 | 16.0 ~16.1 |
| 2.0 | 16.1 ~16.2 | 16.1 ~16.2 | 16.1 ~16.2 | 16.1 ~16.2 | 16.1 ~16.2 | 16.1 ~16.2 | 16.1 ~16.2 | 16.1 ~16.2 | 16.1 ~16.2 | 16.25 ~16.35 | 16.2 ~16.3 | 16.1 ~16.2 | 16.1 ~16.2 |
| 1.9 | 16.2 ~16.3 | 16.2 ~16.3 | 16.2 ~16.3 | 16.2 ~16.3 | 16.2 ~16.3 | 16.2 ~16.3 | 16.2 ~16.3 | 16.3 ~16.4 | 16.35 ~16.45 | 16.35 ~16.45 | 16.3 ~16.4 | 16.2 ~16.3 | 16.2 ~16.3 |
| 1.8 | 16.3 ~16.4 | 16.3 ~16.4 | 16.3 ~16.4 | 16.3 ~16.4 | 16.3 ~16.4 | 16.3 ~16.4 | 16.4 ~16.5 | 16.45 ~16.55 | 16.45 ~16.55 | 16.4 ~16.5 | 16.3 ~16.4 | 16.3 ~16.4 | 16.3 ~16.4 |
| 1.7 | 16.4 ~16.5 | 16.4 ~16.5 | 16.4 ~16.5 | 16.4 ~16.5 | 16.4 ~16.5 | 16.5 ~16.6 | 16.5 ~16.6 | 16.55 ~16.65 | 16.55 ~16.65 | 16.5 ~16.6 | 16.4 ~16.5 | 16.4 ~16.5 | 16.4 ~16.5 |
| 1.6 | 16.5 ~16.6 | 16.5 ~16.6 | 16.5 ~16.6 | 16.5 ~16.6 | 16.6 ~16.7 | 16.7 ~16.8 | 16.65 ~16.75 | 16.6 ~16.7 | 16.5 ~16.6 | 16.5 ~16.6 | 16.5 ~16.6 | 16.5 ~16.6 | 16.5 ~16.6 |
| 1.5 | 16.6 ~16.7 | 16.6 ~16.7 | 16.6 ~16.7 | 16.7 ~16.8 | 16.8 ~16.9 | 16.75 ~16.85 | 16.7 ~16.8 | 16.6 ~16.7 | 16.6 ~16.7 | 16.6 ~16.7 | 16.6 ~16.7 | 16.6 ~16.7 | 16.6 ~16.7 |
| 1.4 | 16.7 ~16.8 | 16.7 ~16.8 | 16.8 ~16.9 | 16.85 ~16.95 | 16.8 ~16.9 | 16.7 ~16.8 | 16.7 ~16.8 | 16.7 ~16.8 | 16.7 ~16.8 | 16.7 ~16.8 | 16.7 ~16.8 | 16.7 ~16.8 | 16.7 ~16.8 |
| 1.3 | 16.8 ~16.85 | 16.8 ~16.85 | 16.85 ~16.95 | 16.85 ~16.95 | 16.8 ~16.85 | 16.8 ~16.85 | 16.8 ~16.85 | 16.8 ~16.85 | 16.8 ~16.85 | 16.8 ~16.85 | 16.8 ~16.85 | 16.8 ~16.85 | 16.8 ~16.85 |
| 1.2 | 16.85 ~16.3 | 16.85 ~16.2 | 16.85 ~16.1 | 16.85 ~16.0 | 16.85 ~16.1 | 16.85 ~16.2 | 16.85 ~16.3 | 16.85 ~16.4 | 16.85 ~16.5 | 16.85 ~16.6 | 16.85 ~16.7 | 16.85 ~16.8 | 16.85 ~16.9 |

R1 R2

FIG.14

| ABSOLUTE VALUE OF LEAN LIMITE A/F | | | | | | | | | | | | | |
|---|---|---|---|---|---|---|---|---|---|---|---|---|---|
| w \ d | 1.7 | 1.8 | 1.9 | 2.0 | 2.1 | 2.2 | 2.3 | 2.4 | 2.5 | 2.6 | 2.7 | 2.8 | 2.9 |
| 1.7 | 16.4 ~16.5 | 16.4 ~16.5 | 16.4 ~16.5 | 16.4 ~16.5 | 16.4 ~16.5 | 16.5 ~16.6 | 16.5 ~16.6 | 16.55 ~16.65 | 16.55 ~16.65 | 16.5 ~16.6 | 16.4 ~16.5 | 16.4 ~16.5 | 16.4 ~16.5 |
| 1.5 | 16.6 ~16.7 | 16.6 ~16.7 | 16.6 ~16.7 | 16.7 ~16.8 | 16.8 ~16.9 | 16.75 ~16.85 | 16.7 ~16.8 | 16.6 ~16.7 | 16.6 ~16.7 | 16.6 ~16.7 | 16.6 ~16.7 | 16.6 ~16.7 | 16.6 ~16.7 |

SPARK PLUG

CROSS REFERENCE TO RELATED DOCUMENT

The present application claims the benefit of priority of Japanese Patent Application No. 2016-173408 filed on Sep. 6, 2016, the disclosure of which is incorporated herein by reference.

BACKGROUND

1 Technical Field

The invention relates generally to a spark plug for an internal combustion engine used in, for example, an automotive vehicle.

2 Background Art

Some of spark plugs used as an ignition device for spark-ignition engines such as internal combustion engines mounted in automotive vehicles are equipped with a center electrode and a ground electrode which face each other in an axial direction of the park plug to define a discharge gap (also called a spark gap). This type of spark plugs work to create a sequence of sparks in the spark gap to ignite an air-fuel mixture in a combustion chamber of the engine.

Typically, flows of the mixture, such as swirls or tumbles, are created within the combustion chamber. Such mixture flows also pass through the spark gap to ensure ignition of the mixture in the combustion chamber. A portion of the ground electrode joined to a head of a housing (also called a metal shell) of the spark plug may, however, be located on an upstream side of the spark gap in the mixture flow depending upon an orientation of the spark plug mounted in the internal combustion engine (which will also be referred to below as mounting orientation). The portion of the ground electrode, thus, obstructs the mixture flow in the combustion chamber, which may lead to a risk that the mixture flow is stagnated around the spark gap, which results in a deterioration of ignition ability of the spark plug. In other words, the spark plugs have a drawback that the ignition ability varies depending upon the mounting orientation thereof. In recent years, lots of lean-burn internal combustion engines become frequently used. Such types of engines have a risk that the mounting orientation of the spark plug results in instability of combustion of the mixture.

Usually, it is difficult for internal combustion engines to control the mounting orientation of the spark plug, that is, the location of the ground electrode in a circumferential direction of the spark plug. This is because the mounting orientation of the spark plug usually depends upon orientation of an external thread formed on the housing of the spark plug or the degree to which the spark plug is fastened into the internal combustion engine in a spark plug mounting operation.

Japanese Patent First Publication No. 9-148045 teaches a spark plug designed to have a ground electrode in which a hole is formed or which is welded to the housing through a plurality of thin plates in order to eliminate the problem that the ground electrode obstructs the mixture flow.

The hole formed in the ground electrode of the spark plug may, however, result in a decrease in mechanical strength of the ground electrode. Thickening the ground electrode to ensure the mechanical strength thereof will facilitate interruption of the mixture flow.

Further, the use of the thin plates through which the ground electrode is welded to the housing results in a complicated configuration of the ground electrode, which will lead to an increased number of production processes or increased production cost of the spark plug.

SUMMARY

It is therefore an object to provide a spark plug which has a simplified structure and is capable of ensuring the stability of combustion of fuel in an engine.

According to one aspect of the disclosure, there is provided a spark plug for an internal combustion engine which may be used with automobiles. The spark plug comprises: (a) a cylindrical metal shell which has an end and is mounted in an internal combustion engine; (b) a center electrode which is retained by the metal shell and electrically isolated from the metal shell, the center electrode having a length and being exposed outside the end of the metal shell; and (c) a ground electrode which has a length and is joined to the end of the metal shell, the ground electrode extending to have an inner surface facing an end of the center electrode.

The ground electrode has a maximum dimension in a first direction perpendicular to a second direction. The second direction is a direction in which the inner surface faces the end of the center electrode. The maximum dimension is selected to meet a relation of 1.3 (mm) 2.0 (mm).

A distance between a first center and a second center is selected to meet a relation below. The first center is the center of an end surface of the center electrode in an axial direction thereof. An imaginary plane is defined to pass through the first center perpendicular to the axial direction of the center electrode. The second center is the center of a line of intersection between the imaginary plane and the inner surface of the ground electrode.

$$W+0.525 \leq d \leq 1.07W+0.66$$

where d is the distance between the first center and the second center, and W is the maximum dimension of the ground electrode.

The above structure of the spark plug ensures a desired flow velocity of, for example, an air-fuel mixture around the spark gap in the engine even when the ground electrode is located upstream of the center electrode in the flow of the air-fuel mixture in a combustion chamber of the engine, in other words, where there is the highest probability that the flow of the air-fuel mixture stalls around the spark gap. In brief, the spark plug is capable of minimizing a deterioration in ignition of the air-fuel mixture within the combustion chamber which arises from the undesirable orientation of the spark plug to the engine. The stability in igniting the air-fuel mixture, as achieved by the spark plug regardless of a mounting orientation of the spark plug to the engine, eliminates the need for paying special attention to installation of the spark plug, e.g., configuration of a mounting thread in the engine head or fastening of the spark plug into the engine head. The stability of the ignition is achieved only by meeting two kinds of dimensional conditions of the above maximum dimension and the distance between the first and second centers. This enables the spark plug to have a simplified structure to eliminate the instability of the ignition of the air-fuel mixture.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 5 is a graph which represents results of ignition performance tests on the spark plug of FIG. 1;

FIG. 14 is a graph which represents results of ignition performance tests on the spark plug of FIG. 13;

DESCRIPTION OF THE PREFERRED EMBODIMENTS

Figure 1:
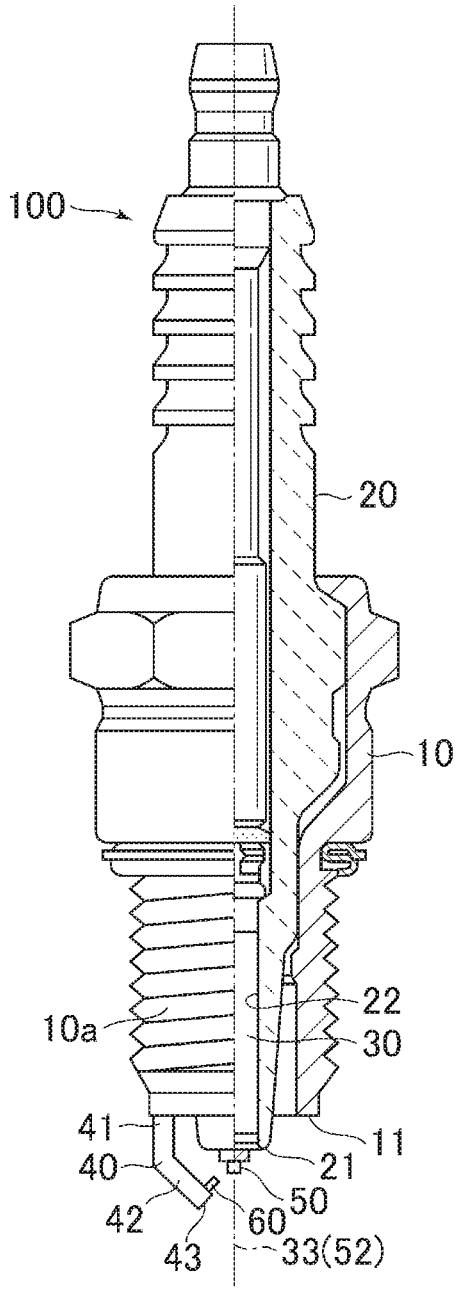
FIG. 1 is a partial longitudinal sectional view which illustrates a spark plug according to an embodiment.

Referring now to the drawings, wherein like reference numbers will refer to like parts throughout the several views, there is shown the spark plug 100 according to an embodiment of this disclosure.

The spark plug 100 illustrated in FIGS. 1 to 4 is used with an automotive engine. The spark plug 100 is fastened into a screw hole formed in an engine head (not shown) which defines a combustion chamber in the engine.

The spark plug 100 is, as illustrated in FIG. 1, equipped with the metal shell 10 serving as a mounting housing. The metal shell 10 is of a hollow cylindrical shape and made of a conductive ferrous material such as low-carbon steel. The metal shell 10 has the mounting thread 10*a* which is fastened into an engine block, not shown. The metal shell 10 has fixedly disposed therein the insulator 20 which is made of alumina ceramic ($Al_2O_3$). The insulator 20 has the end 21 (i.e., a head) exposed outside the end 11 of the metal shell 10.

Figure 2:
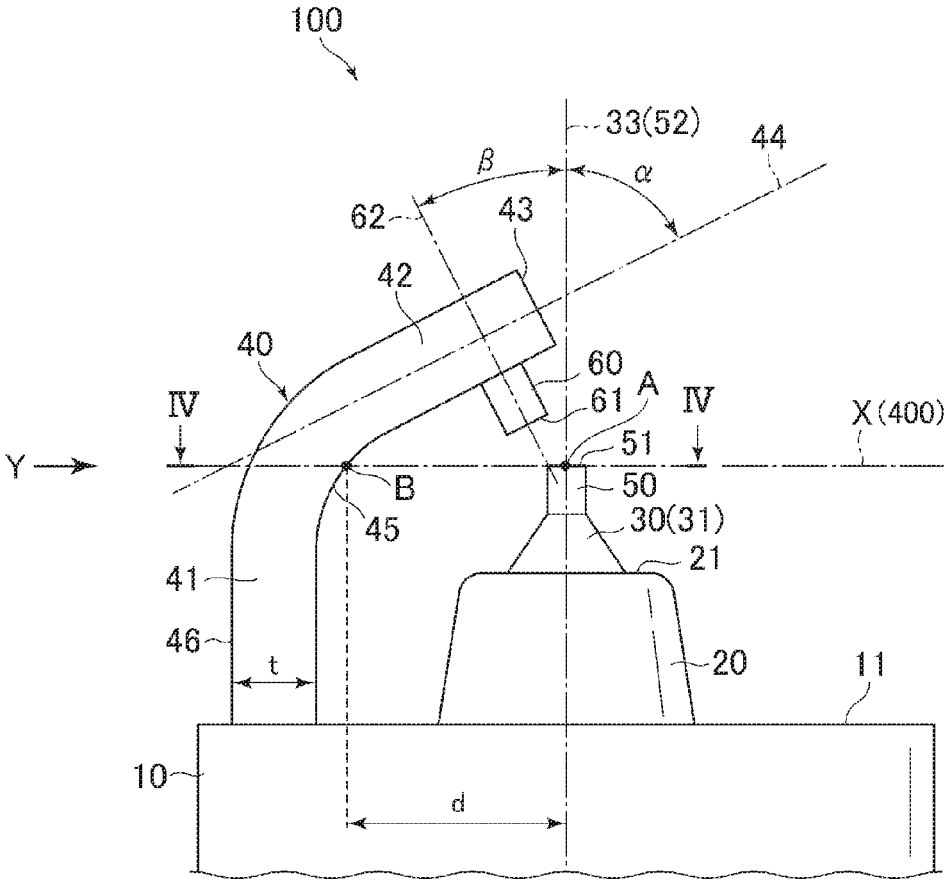
FIG. 2 is a partial enlarged view which illustrates a region around a spark gap of the spark plug of FIG. 1.

The spark plug 100 also includes the center electrode 30 and the ground electrode 40 each of which is of a column-like shape and has a given length. The center electrode 30 is secured in the axial hole 22 of the insulator 20. The center electrode 30 is electrically isolated from the metal shell 10. The center electrode 30 is of a cylindrical shape and made up of an inner core and an outer core. The inner core is made of a high thermal conductive metallic material, such as Cu. The outer core is made of a high heat and corrosion resistant material, such as a Ni-based metallic alloy. The center electrode 30, as can be seen in FIG. 2, has the tapered end portion 31 extending outside the end 21 of the insulator 20.

The ground electrode 40 has a length made up of the first end portion 41 and the second end portion 42. The ground electrode 40 is welded at the first end portion 41 to the end 11 of the metal shell 10. The ground electrode 40 is bent to have the second end portion 42 which extends from the first end portion 41 toward the end portion 31 of the center electrode 30 at an acute angle to the axis 33 (i.e., a longitudinal center line) of the center electrode 30. The ground electrode 40 is of a cylindrical (e.g., rectangular or prismatic shape). For instance, the ground electrode 40, as clearly illustrated in FIG. 4, has a rectangular transverse cross section extending perpendicular to the length thereof.

Specifically, an angle, as clearly illustrated in FIG. 2, which the axis 44 (i.e., a longitudinal center line) of the second end portion 42 of the ground electrode 40 which passes through the end surface 43 (which will also be referred to below as a ground electrode end surface) of the second end portion 42 makes with the axis 33 (i.e., a longitudinal center line) of the center electrode 30 is selected to be an acute angle a. In other words, the ground electrode 40 (i.e., the second end portion 42) is geometrically oriented to slant toward the center electrode 30. The ground electrode 40 is made of Ni-based alloy which mainly contains Ni.

The angle a, as defined herein, is an angle which the longitudinal center line (i.e., the axis 44) of the second end portion 42 of the ground electrode 40 makes with the longitudinal center line of the spark plug 100 (i.e., the axis 33 or 52 of the center electrode 30 or the center electrode chip 50) which are projected on a plane which is defined to extend through the axis 33 of the center electrode 30 and the center of a surface of contact (i.e., a joint) between the end of the ground electrode and the end of 11 of the metal shell 10.

The center electrode 30 has the noble metal chip 50 (which will also be referred to as a center electrode chip) laser-welded to the end portion 31. The center electrode chip 50 extends in alignment with the axis 33 of the center electrode 30. In other words, the axis 33 of the center electrode 30 coincides with the axis 52 of the center electrode chip 50, but however, the axes 33 and 52 may alternatively be oriented out of alignment with each other, that is, may extend parallel to each other.

The second end portion 42 of the ground electrode 40 has the inner surface 45 which faces the center electrode 30 and to which the cylindrical noble metal chip 60 (which will also be referred to below as a ground electrode chip) welded. The ground electrode chip 60, as can be seen in FIG. 2, extends outside the joint thereof to the ground electrode 40, in other words, protrudes outside the width of the ground electrode end surface 43 toward the center electrode chip 50. The ground electrode chip 60 extends toward the tip end surface 51 of the center electrode chip 50 to form a spark gap between the tip end surface 61 thereof and the tip end surface 51 of the center electrode chip 50.

The center electrode chip 50 has the axis 52 (i.e., a longitudinal center line) which obliquely intersects with, traverses, or passes over the axis 62 of the ground electrode 30 at a given interval away from each other. Specifically, an angle β, as illustrated in FIG. 2, which the axis 52 of the center electrode 30 makes with the axis 62 of the ground electrode chip 60 is preferably selected to minimize a volume of a flame kernel which directly contacts with the ground electrode 40 to decrease a cooling loss (i.e. heat loss) of the flame kernel. The angle β is preferably greater than or equal to 5° and less than or equal to 7°.

The weld (i.e., joint) of the ground electrode chip 60 to the ground electrode 40 is, as clearly illustrated in FIG. 2, located on the opposite side (i.e., an upper side, as viewed in FIG. 2) of the tip end surface 51 of the center electrode chip 50 to the metal shell 10 in the direction of the axis 33 of the center electrode 30. In other words, the tip end surface 51 of the center electrode chip 50 is located between the weld of the ground electrode chip 60 and the metal shell 10 in the longitudinal direction of the spark plug 100.

The center electrode chip 50 may be shaped to have a column or disc shape and is preferably made of a prismatic or cylindrical member. In order to minimize the cooling loss (i.e., heat loss) of a flame kernel to the material of the ground electrode 40, the ground electrode chip 60 is preferably shaped in the form of a bar which has the tip end surface (i.e., a discharge surface) 61 located away from the ground electrode 40.

The material of the center electrode chip 50 and the ground electrode chip 60 may be selected from one of alloys: Pt (platinum)-Ir (iridium), Pt—Rh (rhodium), Pt—Ni (nickel), Ir—Rh, and Ir—Y (yttrium).

The center electrode chip 50 and the ground electrode chip 60 may also be made of an alloy which mainly contains Pt and an additive selected from at least one of Ir, Ni, Rh, W, Pd, Ru, and Os. For instance, such an alloy mainly containing Pt and an additive of at least one of Ir of 50% or less by weight (wt %), Ni of 40 wt % or less, Rh of 50 wt % or less, W of 30 wt % or less, Pd of 40 wt % or less, Ru of 30 wt % or less, and Os of 20 wt % or less.

The material of the center electrode chip 50 and the ground electrode chip 60 may alternatively be an alloy which mainly contains Ir and an additive of at least one of Rh, Pt, Ni, W, Pd, Ru, and Os. For instance, such an alloy mainly containing Ir and an additive of at least one of Rh of 50 wt % or less, Pt of 50 wt % or less, Ni of 40 wt % or less, W of 30 wt % or less, Pd of 40 wt % or less, Ru of 30 wt % or less, and Os of 20 wt % or less.

In operation of the spark plug 100, sparks are created in the spark gap between the tip end surfaces 51 and 61 of the chips 50 and 60, thereby igniting an air-fuel mixture in a combustion chamber of the engine. A flame kernel, as developed by the spark in the spark gap, grows, thereby achieving combustion of the mixture in the combustion chamber.

Figure 3:
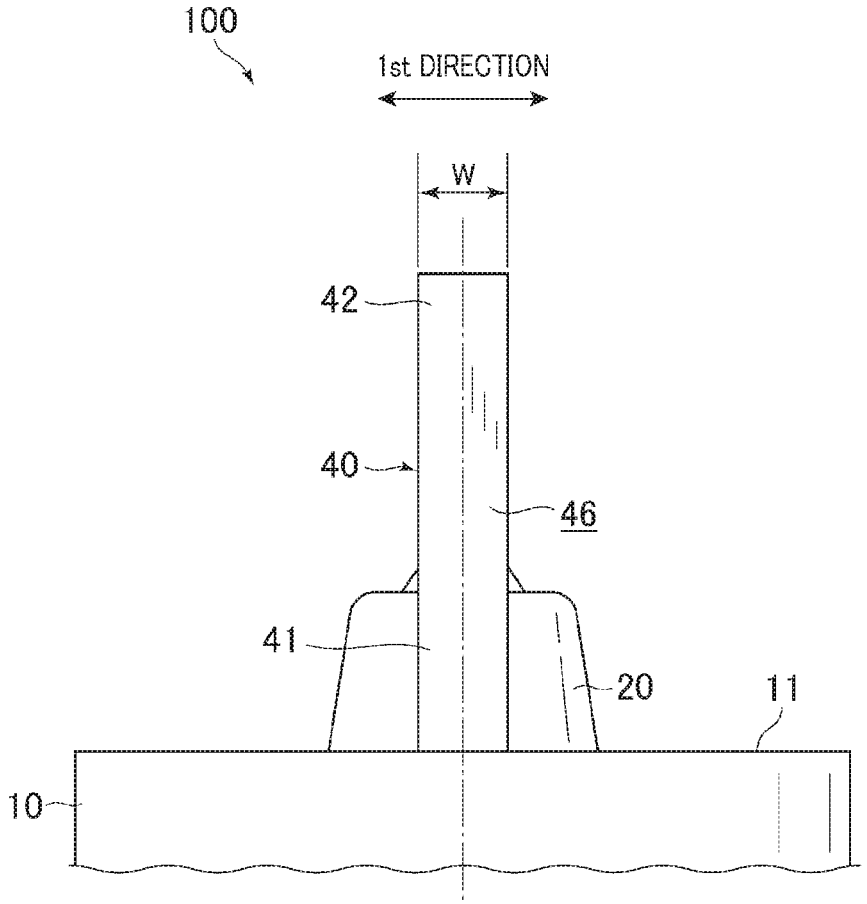
FIG. 3 is a partial side illustration, as viewed in a direction Y in FIG. 2.
Figure 4:
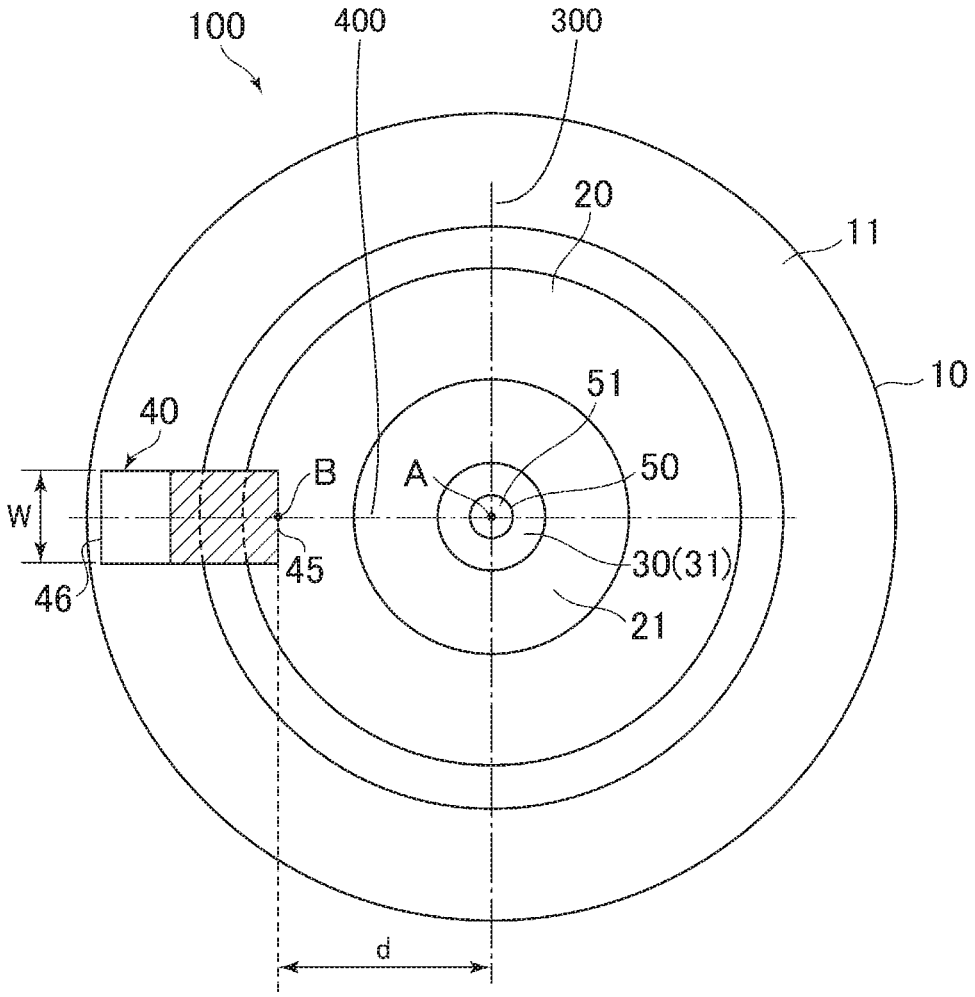
FIG. 4 is a sectional view of a spark plug, as taken along the line IV-IV in FIG. 2.

The spark plug 100 is, as can be seen in FIGS. 3 and 4, designed to have a maximum width W (mm) of the ground electrode 40 in a circumferential direction of the metal shell 10. In the following discussion, the maximum width W will also be referred to as a maximum dimension. In a case where the ground electrode 40 is of a cylindrical shape and has a circular or oval transverse cross section taken perpendicular to the length of the ground electrode 40, the maximum width W corresponds to a maximum diameter of the ground electrode 40. In this disclosure, the maximum dimension W is defined by a dimension of the ground electrode 40 in a first direction in which the line 300, as illustrated in FIG. 4, extends. The first direction is perpendicular to a second direction in which the line 400 extends. The second direction is a direction in which the inner side surface 45 of the ground electrode 40 faces the end of the center electrode 30 (i.e., the tip end surface 51 of the center electrode chip 50). In other words, the second direction is a direction in which the second line 400 extends substantially parallel to the surface of the end 11 of the metal shell 10 between the longitudinal center line of the first end portion 41 of the ground electrode 40 and the longitudinal center line (i.e., the axis 33 or 52) of the center electrode 30.

The maximum width W of the ground electrode 40 is selected to meet a relation of 1.3 mm≤W≤2.0 mm. In the following discussion, the maximum width W will be simply referred to as the width W of the ground electrode 40. In this embodiment, the ground electrode 40, as described above, has a rectangular transverse cross section. The maximum width W, thus, corresponds to a width of the inner surface 45 of the second end portion 42 of the ground electrode 40 which faces the center electrode chip 50 on the end portion 31 of the center electrode 30. The inner surface 45 will also be referred to as a side surface of the ground electrode 40. The maximum width W may alternatively be a width of the outer side surface 46 of the ground electrode 40. The outer side surface 46 is one of four side surfaces of the ground electrode 40 which extend in the lengthwise direction of the ground electrode 40 and is located on the opposite side of the inner surface 45 to the center electrode 30, in other words, opposed to the inner surface 45 through a dimension of the ground electrode 40 perpendicular to the width W.

When the width W is selected to meet the above condition, it is advisable that the distance d (i.e., a minimum distance mm), as illustrated in FIGS. 2 and 4, between the center A and the center B satisfy equation (1) below. The center A, which will also be referred to below as a first center, is the center of the end surface of the end portion 31 of the center electrode 30 (i.e., the center of the tip end surface 51 of the center electrode chip 50 in the axial direction (i.e., the longitudinal direction) of the center electrode 31). The center B, which will also be referred to below as a second center, is the center of a line of intersection between the imaginary plane X and the inner surface 45 of the ground electrode 40. The imaginary plane X extends through the center A of the end surface of the tip end portion 51 perpendicular to the axis 33 of the center electrode 30 (i.e., the longitudinal center line of the metal shell 10), in other words, extends parallel to the horizontal direction in FIG. 2 or parallel to a paper surface of the drawing of FIG. 4.

$$W+0.525 \leq d \leq 1.07W+0.66 \quad (1)$$

The distance d (mm) is more preferably selected to meet equation (2) below.

$$W+0.6 \leq d \leq 1.17W+0.42 \quad (2)$$

The distance d may be expressed by a length of a horizontal line (i.e., the second line 400) extending from the center A of the tip end surface 51 of the center electrode chip 50 perpendicular to the inner surface 45 along the imaginary plane X.

A flow of air-fuel mixture, as created in the combustion chamber of the internal combustion engine, adequately moves into the spark gap between the center electrode 30 and the ground electrode 40 to achieve ignition of the spark plug 100. There is, as described above, a risk that the ground electrode 40 is located on an upstream side of the spark gap along the flow of the mixture than the center electrode 30 is depending upon the mounting orientation of the spark plug 100 to the internal combustion engine.

The mounting orientation of the spark plug 100 may also result in the ground electrode 40 being located downstream of the spark gap or at the same position as the spark gap along the flow of the mixture. When the ground electrode 40 is located on the upstream side of the spark gap, it may cause the flow of the mixture to be obstructed by the ground electrode, so that it stalls around the spark gap, thereby resulting in instability of ignition of the mixture within the combustion chamber.

In order to alleviate the above problem, the spark plug 100 of this embodiment is designed to have the ground electrode 40 whose maximum width W (mm) is selected to meet a relation of $1.3 \leq W \leq 2.0$ and also have the distance d between the ground electrode 40 and the center electrode 30 which satisfies the above equation (1) or (2). This ensures a desired flow velocity of the mixture around the spark gap even when the ground electrode 40 is located upstream of the center electrode 30 in the flow of the mixture in the combustion chamber, in other words, there is the highest probability that the flow of the mixture stalls around the spark gap. In brief, the spark plug 100 of this embodiment is capable of minimizing a deterioration in the ignition of the mixture within the combustion chamber which arises from the undesirable orientation of the spark plug 100 to the engine. The stability in igniting the mixture, as achieved by the spark plug 100 regardless of the mounting orientation of the spark plug 100 to the engine, eliminates the need for paying a special attention to installation of the spark plug 100, e.g., configuration of the mounting thread in the engine head or fastening of the spark plug 100 into the engine head. The stability of the ignition is, as described above, achieved only by meeting two kinds of dimensional conditions of the width W of the ground electrode 40 and the distance d between the center electrode 30 and the ground electrode 40. This enables the spark plug 100 to have a simplified structure to eliminate the instability of the ignition of the mixture. The reasons why the above beneficial advantages are offered by selecting the width W and the distance d to meet the above equations (1) and (2) will be discussed later with reference to FIGS. 11 and 12.

The spark plug 100 is also designed to slant inwardly in the radial direction thereof, in other words, to have the second end portion 42 of the ground electrode 40 which is obliquely oriented toward the end portion 31 of the center electrode 30 so that the angle a between the axis of the ground electrode 40 (i.e., the second end portion 42) and the axis 33 of the center electrode 30 is an acute angle (i.e., less than 90°). This enables the ground electrode 40 to be shortened to facilitate transfer of heat therefrom as compared with typical spark plugs with the ground electrode 40 which is bent substantially at right angles to the axis 33 of the center electrode 30 to have a tip portion extending over the tip of the center electrode 30. The structure of the spark plug 100 of this embodiment ensures a desired degree of heat resistance of the ground electrode 40 without sacrificing the mechanical strength thereof.

The spark plug 100 is also equipped with the center electrode chip 50 which is in the shape of a bar and extends or protrudes from the tip of the end portion 31 of the center electrode 30. The end surface of the end portion 31 of the center electrode 30, as referred to in Eqs. (1) and (2), is the tip end surface 51 of the center electrode chip 50. The direction of the axis 52 of the center electrode chip 50 coincides with that of the axis of the spark plug 100 (i.e., the longitudinal center line of the metal shell 10). The center electrode chip 50 may be shaped in a cylindrical form having a circular transverse cross section. This facilitates the welding of the center electrode chip 50 to the center electrode 30.

The spark plug 100 is also equipped with the ground electrode chip 60 which is in the shape of a bar (e.g., a cylindrical bar) and extends or protrudes from the inner surface 45 of the ground electrode 40 toward the center electrode chip 50 of the center electrode 30 to define the spark gap between itself and the end of the center electrode chip 50. In other words, the center electrode 30 and the ground electrode 40 define a point-to-point structure in which the noble metal chips 50 and 60 face each other through the spark gap, thereby enhancing the ignitability of the spark plug 100.

The reasons why the distance d between the ground electrode 40 and the center electrode 30 is selected to meet Eq. (1) or (2) in a condition where the width W of the ground electrode 40 satisfies a relation of $1.3 \leq W \leq 2.0$ will be described below with reference to FIGS. 5 to 10.

The above numerical conditions are derived using results of evaluation tests performed on samples of the spark plug 100, as described below.

Each sample of the spark plug 100 has the following specification.

1. The ground electrode 40 has a constant thickness t of 1.3 mm. The thickness t is a dimension illustrated in FIG. 2.
2 The ground electrode chip 60 has a diameter φ of 0.7 mm and a length of 0.8 mm that is a distance between the surface 45 of the ground electrode 40 and the end surface of the ground electrode chip 60.
3 The center electrode chip 50 has a diameter φ of 0.55 mm and a length L of 0.8 mm.
4 The mounting thread 10*a* has a thread diameter (i.e., an outer diameter) of 12 mm.
5 The spark gap is 0.85 mm.
6 The center electrode chip 50 is oriented to have a longitudinal center line (i.e., the axis 52) aligned with the axis of the spark plug 100.

Figure 11:
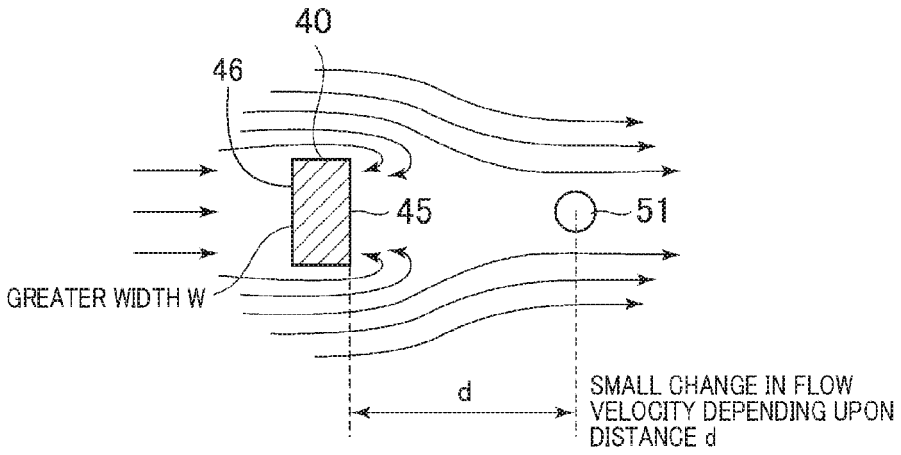
FIG. 11 is a view which demonstrates a flow of air-fuel mixture when a ground electrode has a great width.
Figure 12:
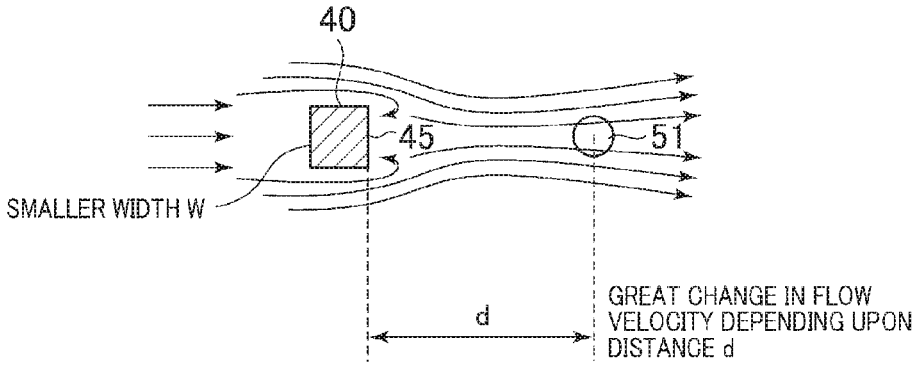
FIG. 12 is a view which demonstrates a flow of air-fuel mixture when a ground electrode has a small width.

The orientation of the spark plug 100 is such that the outer side surface 46 of the ground electrode 40 (opposed to the inner side surface 45) faces the intake valve of the engine, in other words, the outer side of the side surface 46 of the ground electrode 40 is the upstream side of the flow of the mixture (see FIGS. 11 and 12).

We performed ignition performance tests using a 1800 cc four-cylinder engine running at 2,000 rmp. An indicated mean effective pressure Pmi was 0.28 Mpa. The lean limit A/F (i.e., a leanest air-fuel ratio which causes no misfire) was used. Note that a value of the A/F at a point when a 3% variation in Pmi occurs is defined as the lean limit A/F.

For the ignition performance tests, we prepared eleven types of test samples of the spark plug 100 which have values of the width W of the ground electrode 40 different in a unit of 0.1 mm between 1.2 mm and 2.2 mm. We also broke down each type of the test samples which have the same value of the width W into thirteen types which have values of the distance d different in a unit of 0.1 mm between 1.7 mm and 2.9 mm. We, therefore, prepared a total of 143 types of test samples of the spark plug 100 and performed the tests on each type to measure the lean limit A/F five times. We determined a range of the measured values of the lean limit A/F. Note that the distance d was altered by changing the inclination (i.e., the angle a) of the second end portion 42 of the ground electrode 40, a radius of curvature of a bend R of the ground electrode 40, and height of the bend R (i.e., a length of the first end portion 41 extending vertically from the end 11 of the metal shell 10).

Results of the ignition performance tests are shown in a table of FIG. 5. The table lists a range of values of the lean limit A/F, as derived by measuring each of the above 143 types of test samples five times. The table shows that there is, as indicated in cells of the table enclosed by a thick line, a range R1 of the distance d in which the value of the lean limit A/F relatively becomes great, in other words, the stability in combustion in the engine is enhanced and also shows that within the range R1, there is also a range R2, as indicated by hatched lines, in which the value of the lean limit A/F further becomes great, in other words, the stability in combustion in the engine is more enhanced. In the ranges R1 and R2, the value of the distance d increase with an increase in value of the width W.

Figure 6:
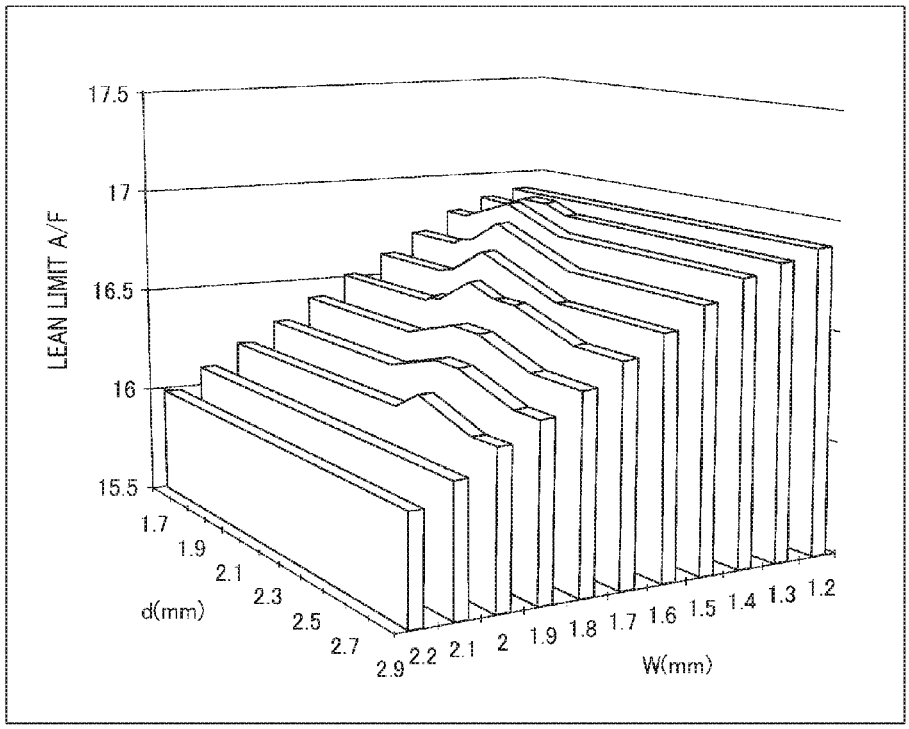
FIG. 6 is a three-dimensional graph of the tests results in FIG. 5.

An average of the values of the lean limit A/F derived by measuring each test sample in FIG. 5 five times, the width W, and the distance d bear relations shown in FIG. 6. FIG. 6 is a three-dimensional graph which discretely represents the width W for each numeral condition. The graph of FIG. 6 shows that the lean limit A/F changes to have a peak as a function of the distance d in a range of 1.3 to 2.0 mm. The graph also shows that the peaks fall in a range in which the distance d becomes great with an increase in the width W and that reference values of the lean limit A/F, as expressed by flat portions of the ranges excluding chevron portions (including the peaks), increase with a decrease in the width W.

Figure 7:
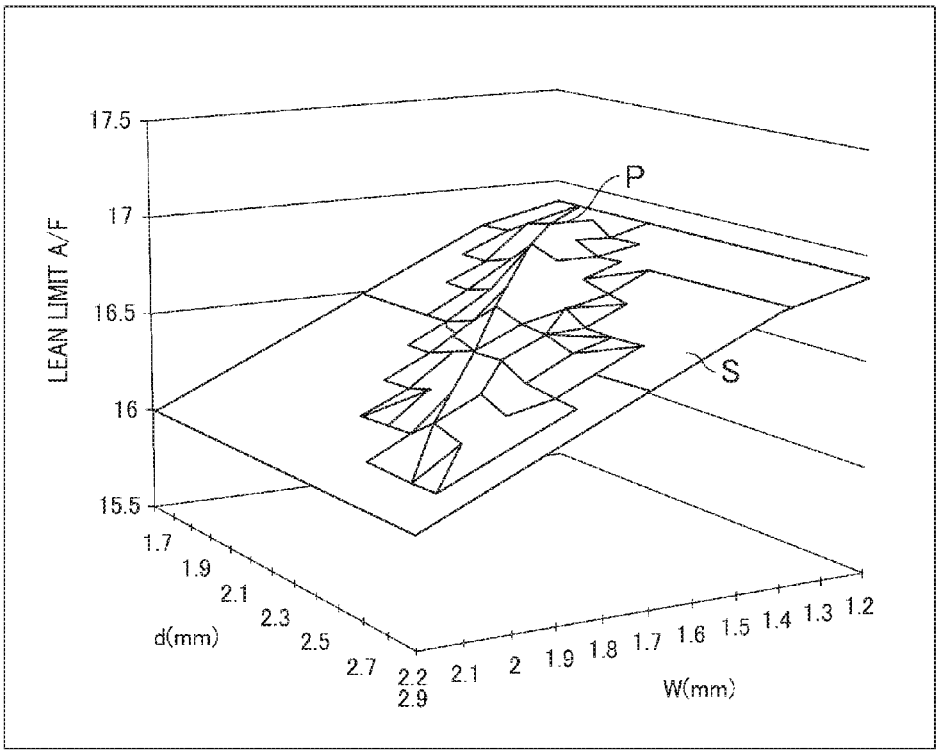
FIG. 7 is a three-dimensional linearly interpolated view of the graph of FIG. 6.

FIG. 7 is a three-dimensional graph derived by interpolating between the adjacent two ranges of the width W in FIG. 6. The graph of FIG. 7 shows that the lean limit A/F basically has a constant reference value in each range of the width Wand there is a slant plane S where the reference value increases with a decrease in the width W. The graph also shows that the lean limit A/F has a ridge portion P which protrudes from the slant plane S to the positive side and extends through the peaks.

Figure 8:
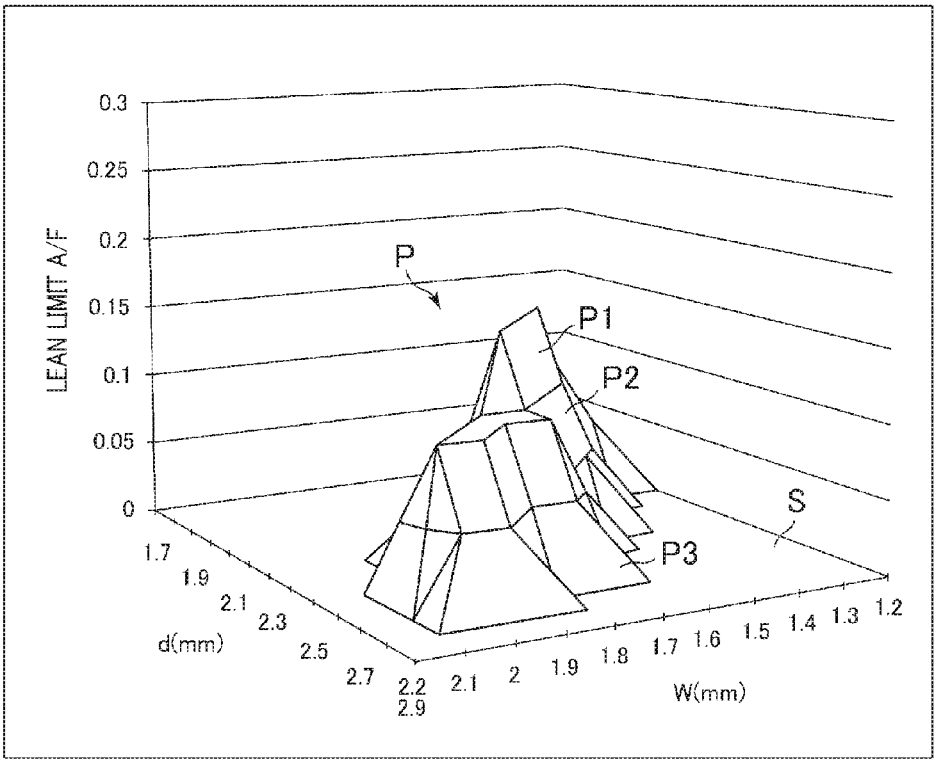
FIG. 8 is a three-dimensional graph which represents a difference between a ridge portion and a reference plan in FIG. 7.

FIG. 8 is a three-dimensional graph which represents a difference between the ridge portion P and the reference plan S for each value of the width W. In FIG. 8, the reference plane S is a horizontal plane including an axis indicating the distance d and an axis indicating the width W. The ridge portion P protrudes in the form of a mountain from the reference plan S. The region P1 is a range in which the lean limit A/F is improved by 0.1 or more based on the reference plane S. The region P2 is a range in which the lean limit A/F is improved by 0.05 or more based on the reference plane S. The region P3 is a range in which the lean limit A/F is improved by less than 0.05 based on the reference plane S.

Figure 9:
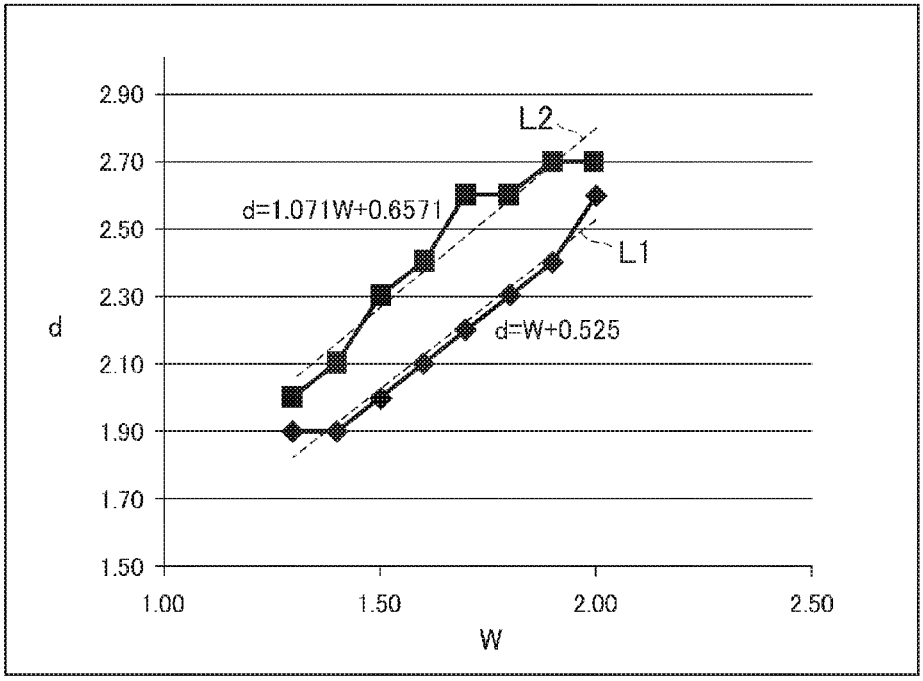
FIG. 9 is a graph which represents a relation between a distance d and a width Win a region where a lean limit A/F is improved by 0.05 or more in FIG. 8.

FIG. 9 is a graph which represents a relation between the distance d and the width W in the region P2 shown in FIG. 8. Specifically, the graph of FIG. 9 indicates a sectional area of the ridge portion P taken along a plane where the lean limit A/F is 0.05 in the three-dimensional graph of FIG. 8. Line segments extending through plotted dots in FIG. 9 represent boundaries between the regions P2 and P3. The boundaries (i.e., the line segments) are linearly approximated to define two lines L1 (d=W+0.525) and L2 (d=1.0714W+0.6571). An area between the approximated lines L1 and L2 indicates a region where the lean limit A/F is improved by 0.05 or more. The graph of FIG. 9, therefore, shows that when the distance d between the ground electrode 40 and the center electrode 30 is selected to meet the above Eq. (1) in the condition where the width W (mm) of the ground electrode 40 satisfies a relation of $1.3 \leq W \leq 2.0$, the lean limit A/F is enhanced to improve the stability of combustion of the mixture in the engine.

Figure 10:
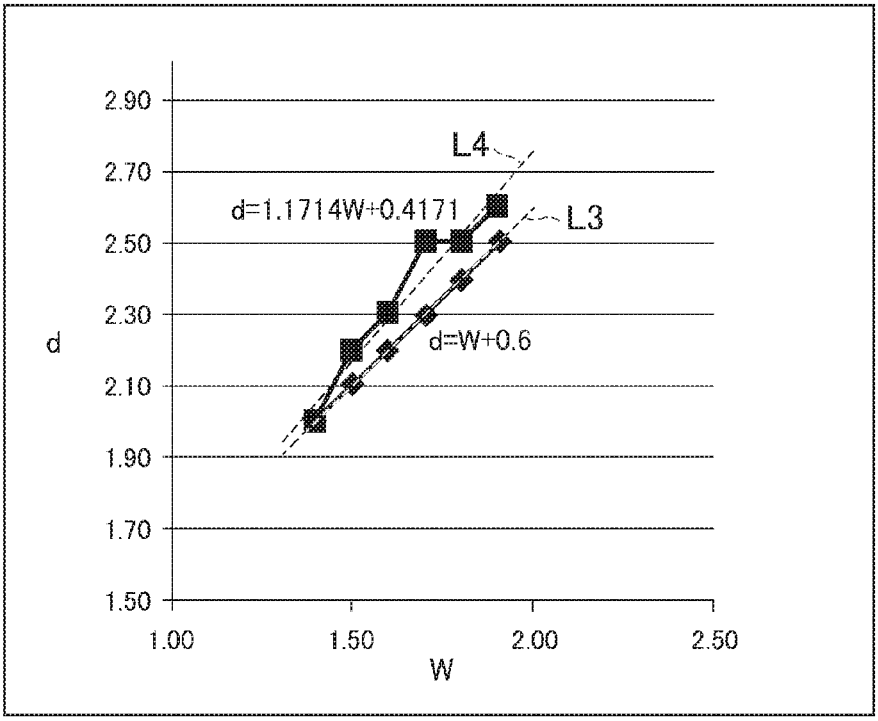
FIG. 10 is a graph which represents a relation between a distance d and a width Win a region where a lean limit A/F is improved by 0.15 or more in FIG. 8.

FIG. 10 is a graph which represents a relation between the distance d and the width Win the region P1 shown in FIG. 8. Specifically, the graph of FIG. 10 indicates a sectional area of the ridge portion P taken along a plane where the lean limit A/F is 0.1 in the three-dimensional graph of FIG. 8. Line segments extending through plotted dots in FIG. 10 represent boundaries between the regions P2 and P3. The boundaries (i.e., the line segments) are linearly approximated to define two lines L3 (d=W+0.6) and L4 (d=1.1714W+0.4171). An area between the approximated lines L1 and L2 indicates a region where the lean limit A/F is improved by 0.05 or more. An area between the approximated lines L3 and L4 indicates a region where the lean limit A/F is improved by 0.1 or more. The graph of FIG. 10, therefore, shows that when the distance d between the ground electrode 40 and the center electrode 30 is selected to meet the above Eq. (2) in the condition where the width W (mm) of the ground electrode 40 satisfies a relation of $1.3 \leq W \leq 2.0$, the lean limit A/F is more enhanced to further improve the stability of combustion of the mixture in the engine.

A mechanism for achieving the optimum value of the distance d derived by selecting the width W of the ground electrode 40 will be discussed below with reference to FIGS. 11 and 12.

When the ground electrode 40 is, as demonstrated in FIG. 11, located more upstream of a flow of the mixture than the center electrode chip 50 (i.e., the tip end surface 51) is within the combustion chamber of the engine, the ground electrode 40 obstructs the flow of the mixture, thereby causing the flow of the mixture to stall around the spark gap on the center electrode 30, which will result in a failure in spreading or extending sparks on the flow of the mixture in the combustion chamber. Typically, it is known that the extension of a spark results in an increase in length of the spark contacting the mixture, thereby facilitating the ease with which the mixture is ignited. The failure in extending the spark, therefore, results in a deterioration of the ignitability of the spark plug 100. The ignitability is, therefore, enhanced by ensuring the stability of the flow of the mixture around the tip end surface 51 of the center electrode chip 50 without stalling it.

A stall of flow of the mixture around the ground electrode 40 develops, behind the ground electrode 40, a region where the flow of the mixture is obstructed by the width W of the ground electrode 40, so that the flow velocity of the mixture is decreased downstream of the ground electrode 40, but such a decrease is not directly proportional to the distance d. Such a region is broken down into two regions: one is where a drop in the flow velocity is great, and the second is where a drop in the flow velocity is small. As demonstrated in FIG. 11, an increase in width W (or the diameter) of the ground electrode 40 will create streams of the mixture greatly separate from a main stream thereof, which will be eddies behind the inner side surface 45 of the ground electrode 40. This results in a decrease in flow velocity of the mixture on the downstream side of the ground electrode 40 independently of the distance d.

A decrease in width W of the ground electrode 40, as demonstrated in FIG. 12, results in a decrease in creation of separate streams of the mixture, which generates small eddies behind the inner side surface 45 of the ground electrode 40. The flow velocity of the mixture is, thus, hardly decreased on the downstream side of the ground electrode 40, thereby creating a region where the flow velocity of the mixture greatly depends upon the distance d behind the ground electrode 40, as compared with the example of FIG. 11, in other words, the flow velocity of the mixture is maximized behind the ground electrode 40. This means that there is a value of the distance d which enhances the ignitability of the spark plug 100.

It is known that when a typical type of ground electrode which has a width W of 2.1 to 2.7 mm and a thickness t of 1.2 to 1.4 mm is located upstream of a center electrode in a flow of the mixture, and the distance d between the ground electrode and the center electrode is set greater than the size of the spark gap, the ignitability remains unchanged. We have, however, found that the ignitability depends upon the distance d between the ground electrode 40 and the spark gap (i.e., the center electrode 30) when the width W of the ground electrode 40 is selected to meet a relation of $1.3 \leq W \leq 2.0$ mm.

MODIFICATIONS

Modifications of the spark plug 100 will be discussed below with reference to FIGS. 13 to 16.

The spark plug 100 of the above embodiment is designed to have the axis 52 of the center electrode chip 50 aligned with the axis of the spark plug 100, but however, the axis of the center electrode chip 50 may alternatively be oriented in misalignment from the axis of the spark plug 100. The axis 62 of the ground electrode chip 60 may intersect with, traverses, or pass over the axis 33 of the center electrode 30 at a given interval away from each other. Alternatively, the center electrode chip 50 may be, as illustrated in FIG. 13, obliquely angled to the ground electrode 40 to have the axis 52 (i.e., the longitudinal center line) extending substantially perpendicular to the inner side surface 45 of the ground electrode 40, in other words, in alignment with the axis 62 of the ground electrode chip 60 (i.e., a direction in which the inner side surface 45 faces the tip end surface 51 of the center electrode chip 50).

Figure 13:
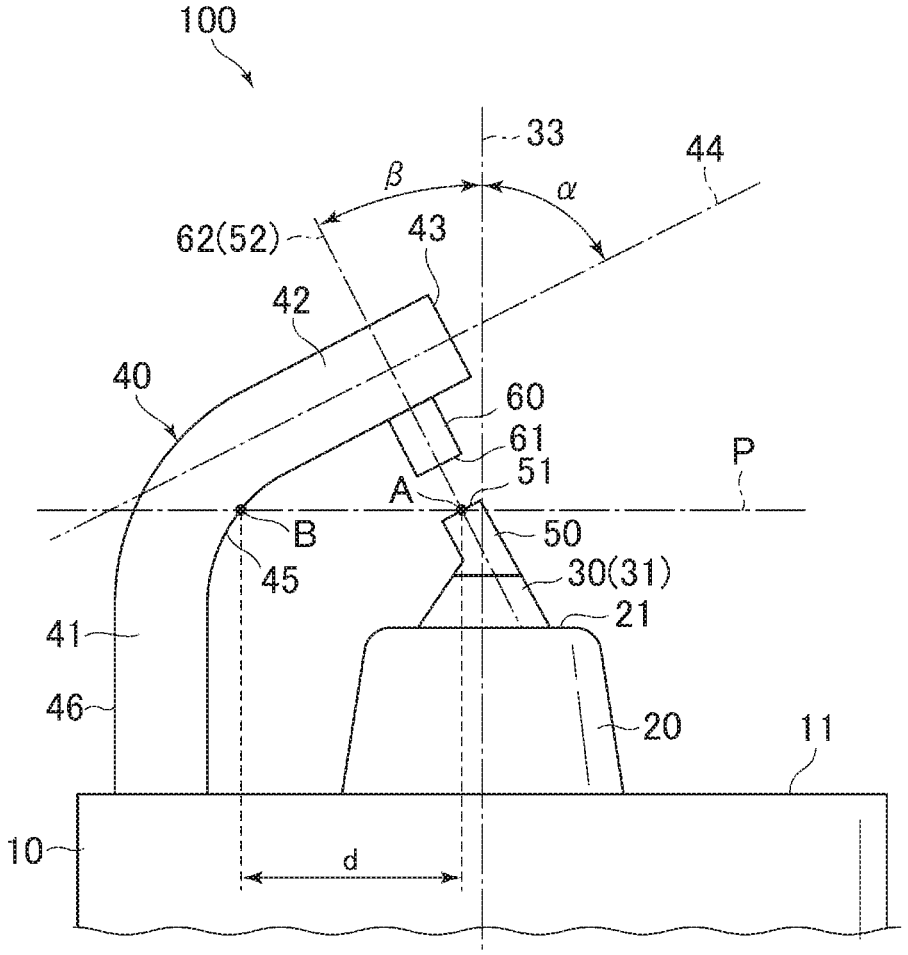
FIG. 13 is an enlarged view which illustrates a region around a spark plug of a modified structure of a spark plug.

We also prepared test samples of the spark plug 100 in FIG. 13 and performed, like in the above embodiment of FIG. 2, ignition performance tests on the test samples. The tests samples are identical in specification with those used in the above embodiment except that the axis 52 of the center electrode chip 50 is aligned with the axis 62 of the ground electrode chip 60.

For the ignition performance tests, we prepared two types of test samples of the spark plug 100 in which the width W of the ground electrode 40 is 1.5 mm and 1.7 mm. We also broke down each type of the test samples which have the same value of the width W into thirteen types which have values of the distance d different in a unit of 0.1 mm between 1.7 mm and 2.9 mm. We, therefore, prepared a total of 26 types of test samples of the spark plug 100 and performed the tests on each type to measure the lean limit A/F five times.

Results of the ignition performance tests are shown in a table of FIG. 14. The table, like in FIG. 5, lists a range of values of the lean limit A/F, as derived by measuring each of the above 26 types of test samples five times. The table shows that substantially the same results of the tests as in the embodiment of FIG. 2 are obtained because the stability of ignitability of the spark plug 100 depends upon the width W of the ground electrode 40 and the state of flow of the mixture (i.e., the flow velocity of the mixture) in a space upstream side of a spark generating point on the ground electrode 30, but is less influenced by the orientation of the axis 52 of the center electrode chip 50 facing the ground electrode chip 60.

Figure 15:
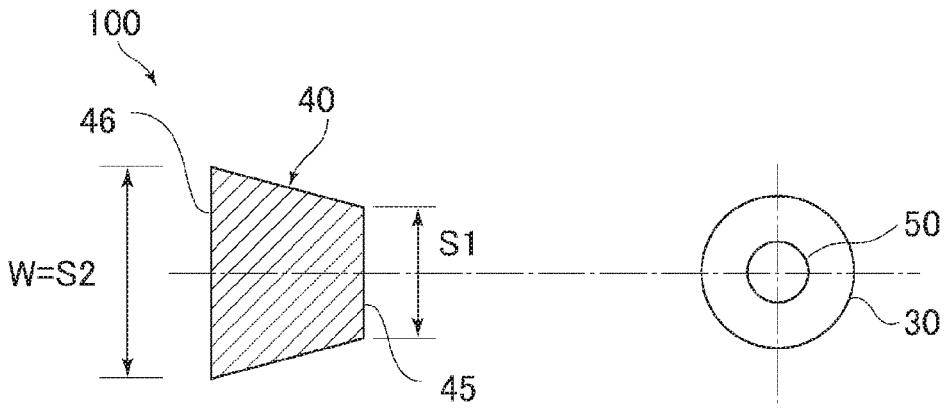
FIG. 15 is a partial transverse section of a modified form of a spark plug.

The ground electrode 40 of the spark plug 100 in the above embodiment and the modification is shaped to have a rectangular transverse cross section, but however, may alternatively have another configuration. For instance, the ground electrode 40 may be, as illustrated in FIG. 15, shaped to have a trapezoidal transverse cross section, as taken perpendicular to the length of the ground electrode 40. In the example of FIG. 15, the inner side surface of the ground electrode 40 forms the shorter base of the trapezoidal, while the outer side surface 46 which faces upstream of flow of the mixture forms the longer base of the trapezoidal. In other words, the ground electrode 40 has the shorter base length S1 and the longer base length S2. The longer base length S2 corresponds to the maximum width W of the ground electrode 40.

Figure 16:
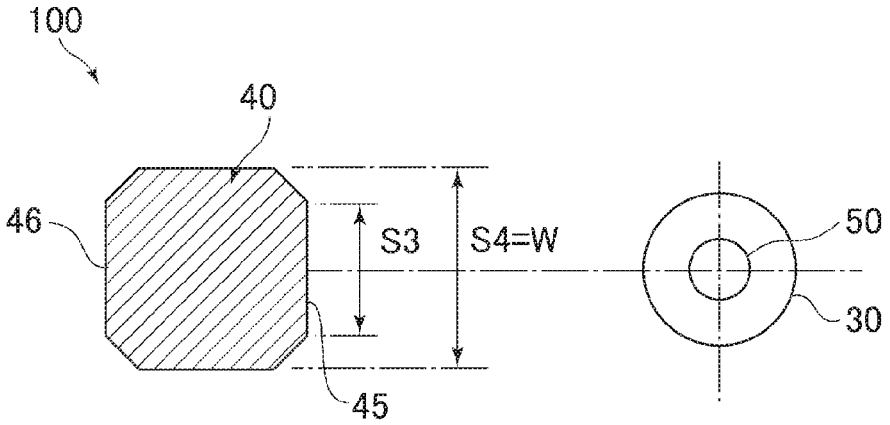
FIG. 16 is a partial transverse section of a modified form of a spark plug.

The ground electrode 40 may alternatively be, as illustrated in FIG. 16, shaped to have chambered corners which define a substantially octagonal transverse sectional area. In this example, the maximum width W of the ground electrode 40 is defined by a minimum distance S4 between two of four longer sides of the ground electrode 40 which are opposed to each other in a direction perpendicular to a line 150 passing through the centers of the ground electrode 40 and the center electrode chip 50, but not a distance S3 between opposed edges of a flat area of either the inner side surface 45 or the outer side surface 46.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiment which can be embodied without departing from the principle of the invention as set forth in the appended claims.

The ground electrode 40 in the above embodiment is designed to slant at a given angle toward the center electrode 30, but may alternatively be formed to have the second end portion 42 which is bent at right angles to the axis 33 of the center electrode 30 and extend over the head of the center electrode 30.

Both the center electrode 30 and the ground electrode 40 are equipped with the noble metal chips 50 and 60, but however, only the center electrode 30 has the noble metal chip 50.

What is claimed is:

1. A spark plug for an internal combustion engine comprising:

a cylindrical metal shell which has an end and is mounted in an internal combustion engine;

a center electrode which is retained by the metal shell and electrically isolated from the metal shell, the center electrode having a length and being exposed outside the end of the metal shell; and a ground electrode which has a length and is joined to the end of the metal shell, the ground electrode extending to have an inner surface facing an end of the center electrode, wherein the ground electrode has a maximum dimension (W) in a first direction perpendicular to a second direction, the second direction being a direction in which the inner surface faces the end of the center electrode, the maximum dimension being determined to meet a relation of 1.3 (mm)≤W≤2.0 (mm), and wherein a distance between a first center and a second center is selected to meet a relation below, the first center being a center of an end surface of the center electrode in an axial direction thereof, the second center being a center of a line of intersection between an imaginary plane and the inner surface of the ground electrode, the imaginary plane passing through the first center perpendicular to the axial direction of the center electrode, $$W+0.525 \leq d \leq 1.07W+0.66$$

where d is the distance between the first center and the second center, and W is the maximum dimension of the ground electrode.

2. A spark plug for an internal combustion engine as set forth in claim 1, wherein the distance d between the first center and the second center is selected to meet:

$$W+0.6 \leq d \leq 1.17W+0.42.$$

3. A spark plug for an internal combustion engine as set forth in claim 1, wherein the ground electrode is shaped to slant toward the center electrode.

4. A spark plug for an internal combustion engine as set forth in claim 3, wherein the center electrode has disposed thereon a column-like center electrode chip which has an end surface defining the end surface of the center electrode, and wherein an axis of the center electrode chip is oriented in alignment with an axis of the spark plug.

5. A spark plug for an internal combustion engine as set forth in claim 3, wherein the center electrode has disposed thereon a column-like center electrode chip which has an end surface defining the end surface of the center electrode, and wherein an axis of the center electrode chip is aligned in a direction in which the inner surface of the ground electrode faces the end of the center electrode.

6. A spark plug for an internal combustion engine as set forth in claim 1, wherein the ground electrode has disposed therein a column-like ground electrode chip which extends from the inner surface of the ground electrode and faces the center electrode through a spark gap.

7. A spark plug for an internal combustion engine as set forth in claim 1, wherein the ground electrode has a straight portion that slants toward a central axis of the center electrode.

8. A spark plug for an internal combustion engine as set forth in claim 7, wherein the straight portion is on an opposite side of the imaginary plane from the center electrode.

* * * * *